US009817340B2

(12) United States Patent
Seki et al.

(10) Patent No.: US 9,817,340 B2
(45) Date of Patent: Nov. 14, 2017

(54) IMAGE FORMING APPARATUS THAT PERFORMS A REFRESHING OPERATION

(71) Applicants: Takahiro Seki, Hyogo (JP); Masanari Fujita, Tokyo (JP); Takeshi Sakashita, Tokyo (JP); Takeshi Yamashita, Osaka (JP); Naoki Takai, Tokyo (JP); Takuya Akiyama, Kanagawa (JP)

(72) Inventors: Takahiro Seki, Hyogo (JP); Masanari Fujita, Tokyo (JP); Takeshi Sakashita, Tokyo (JP); Takeshi Yamashita, Osaka (JP); Naoki Takai, Tokyo (JP); Takuya Akiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/271,968

(22) Filed: Sep. 21, 2016

(65) Prior Publication Data

US 2017/0097589 A1 Apr. 6, 2017

(30) Foreign Application Priority Data

Oct. 2, 2015 (JP) ..... 2015-196547

(51) Int. Cl.
*G03G 15/16* (2006.01)
*G03G 15/01* (2006.01)

(52) U.S. Cl.
CPC ..... *G03G 15/161* (2013.01); *G03G 15/0189* (2013.01); *G03G 2215/1661* (2013.01)

(58) Field of Classification Search
CPC ..... G03G 15/0844; G03G 15/161; G03G 15/0189
(Continued)

(56) References Cited

U.S. PATENT DOCUMENTS 7,269,364 B2 * 9/2007 Tanaka et al. ..... G03G 15/556 399/257
8,965,227 B2 * 2/2015 Mizutani et al. .. G03G 15/1675 399/53
(Continued)

FOREIGN PATENT DOCUMENTS

JP 2008-225253 9/2008
JP 2013-257392 12/2013

OTHER PUBLICATIONS

U.S. Appl. No. 15/152,940, filed May 12, 2016.
U.S. Appl. No. 15/220,318, filed Jul. 27, 2016.

*Primary Examiner* — William J Royer
(74) *Attorney, Agent, or Firm* — Oblon, McClelland, Maier & Neustadt, L.L.P.

(57) ABSTRACT

An image forming apparatus includes an intermediate transfer body, a plurality of image bearers, a plurality of developing devices, a plurality of primary transfer devices, a secondary transfer device, and a cleaner. The plurality of image bearers are disposed side by side along the intermediate transfer body. In a refreshing mode, the plurality of developing devices form toner images on the plurality of image bearers during a non-image-formation period and the cleaner cleans a surface of the intermediate transfer body. In the refreshing mode, a toner image formed on one image bearer of the plurality of image bearers, which differs from a most downstream image bearer of the plurality of image bearers in a direction of conveyance of the intermediate transfer body, reaches the cleaner first of the toner images formed on the plurality of image bearers.

7 Claims, 6 Drawing Sheets

(58) Field of Classification Search
USPC ..... 399/27, 53, 101, 257
See application file for complete search history.

(56) References Cited

U.S. PATENT DOCUMENTS

| | | | |
|---|---|---|---|
| 2008/0131162 | A1 | 6/2008 | Nakatake et al. |
| 2008/0152378 | A1 | 6/2008 | Yamashita et al. |
| 2009/0279909 | A1 | 11/2009 | Matsushita et al. |
| 2011/0058831 | A1 | 3/2011 | Usami et al. |
| 2015/0003852 | A1 | 1/2015 | Yamashita et al. |
| 2016/0033924 | A1 | 2/2016 | Fukao et al. |

* cited by examiner

| | MOST UPSTREAM COLOR | MOST DOWNSTREAM COLOR |
|---|---|---|
| CLEANING FAILURE | NO OCCURRENCE | OCCURRENCE |

FIG. 8

| | UPSTREAM COLOR → MOST DOWNSTREAM COLOR |
|---|---|
| CLEANING FAILURE | NO OCCURRENCE |

FIG. 9

| | PRINT COVERAGE | | DEGREE OF DURABILITY | | ENVIRONMENT | |
|---|---|---|---|---|---|---|
| | OTHER THAN LOW | LOW | OTHER THAN HIGH | HIGH | OTHER THAN HH | HH |
| CLEANING FAILURE | NO OCCURRENCE | OCCURRENCE | NO OCCURRENCE | OCCURRENCE | NO OCCURRENCE | OCCURRENCE |
| UPSTREAM REFRESHING | - | EXECUTED | - | EXECUTED | - | EXECUTED |

IMAGE FORMING APPARATUS THAT PERFORMS A REFRESHING OPERATION

CROSS-REFERENCE TO RELATED APPLICATION

This patent application is based on and claims priority pursuant to 35 U.S.C. §119(a) to Japanese Patent Application No. 2015-196547, filed on Oct. 2, 2015, in the Japan Patent Office, the entire disclosure of which is hereby incorporated by reference herein.

BACKGROUND

Technical Field

Aspects of the present disclosure relate to an imaging forming apparatus such as an electrophotographic copier, a printer, and a facsimile machine.

Related Art

An image forming apparatus may form images on photoconductors of developing units, primarily transfer onto an intermediate transfer body, and transfers the images onto a transfer medium.

When such an image forming apparatus outputs an image having a smaller proportion (hereinafter, referred to as print coverage) of a print area relative to an area in which an image can be formed, the amount of toner used for development is smaller. Accordingly, toner in the developing units is unlikely to be replaced, and the period in which toner remains in the developing units may increase, thus degrading the toner. The degraded toner is stirred and stressed for a long period of time, and a charging capability or a charge-holding capability decreases, which may cause a reduction in image quality due to cleaning failure. In addition, when the degraded toner is continuously charged for a long period of time and remains under stress, such as friction and pressure of a developing blade and a developing roller, toner adhesion might occur.

Hence, image forming apparatuses have been proposed that perform a refreshing operation.

SUMMARY

In as aspect of the present disclosure, there is provided an image forming apparatus that includes an intermediate transfer body, a plurality of image bearers, a plurality of developing devices, a plurality of primary transfer devices, a secondary transfer device, and a cleaner. The plurality of image bearers are disposed side by side along the intermediate transfer body. The plurality of developing devices forms toner images on the plurality of image bearers. The plurality of primary transfer devices are disposed opposing the plurality of image bearers, to sequentially transfer the toner images from the plurality of image bearers to the intermediate transfer body with a primary transfer bias. The secondary transfer device collectively transfers the toner images from the intermediate transfer body to a transfer target with a secondary transfer bias. The cleaner cleans a surface of the intermediate transfer body after transfer. In a refreshing mode, the plurality of developing devices form toner images on the plurality of image bearers during a non-image-formation period and the cleaner cleans the surface of the intermediate transfer body. In the refreshing mode, a toner image formed on one image bearer of the plurality of image bearers, which differs from a most downstream image bearer of the plurality of image bearers in a direction of conveyance of the intermediate transfer body, reaches the cleaner first of the toner images formed on the plurality of image bearers.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 8 is an illustration of the toner refreshing process of the image forming apparatus illustrated in FIG. 1 according to an embodiment of the present disclosure; and FIG. 9 is an illustration of a timing of the toner refreshing process of the image forming apparatus illustrated in FIG. 1 according to an embodiment of the present disclosure.

Figure 1:
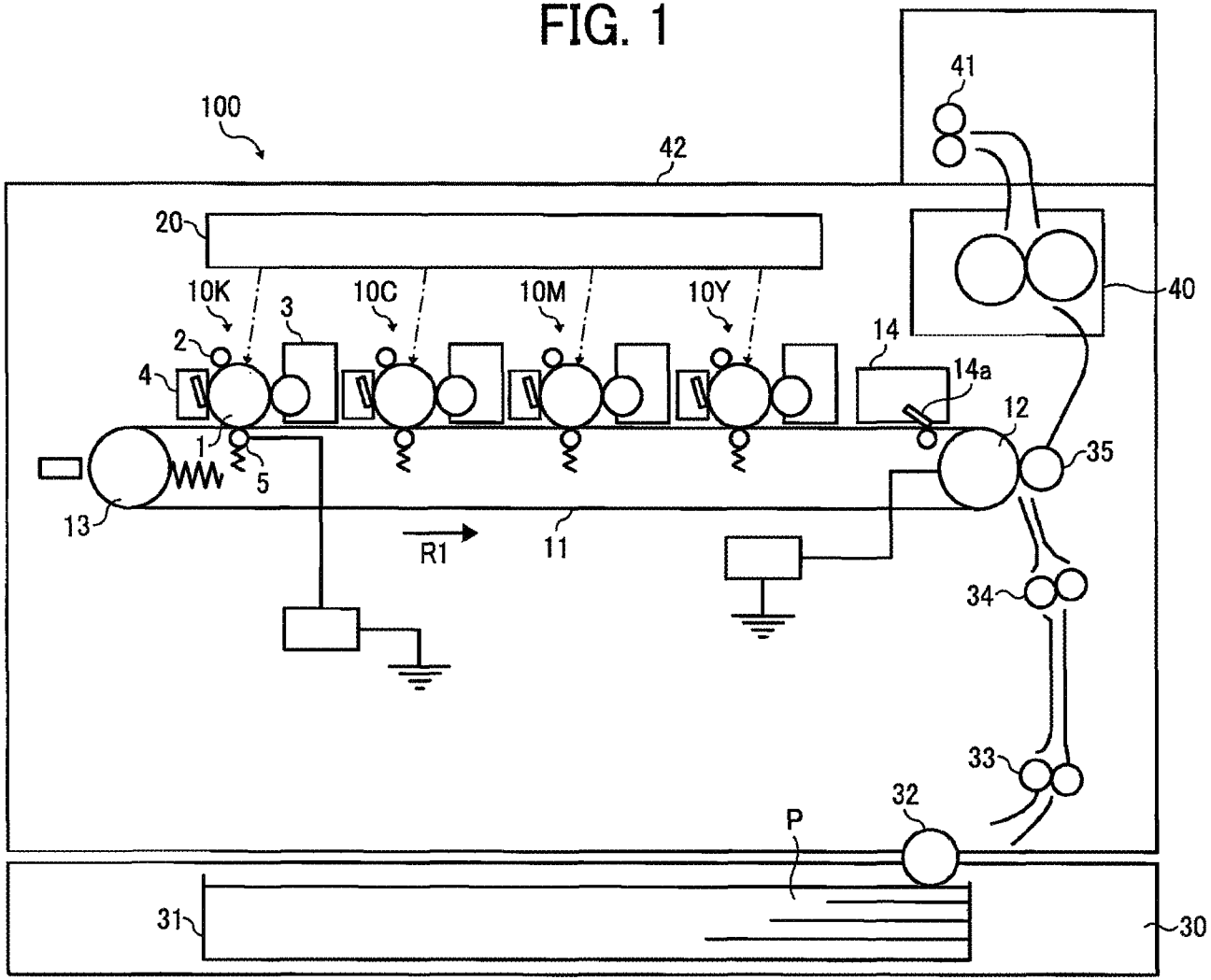
FIG. 1 is a schematic diagram of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components)

having the same function or shape and redundant descriptions thereof are omitted below.

Hereinafter, a configuration of an image forming apparatus 100 according to an embodiment of the present disclosure is described. The description is given by exemplifying an image forming apparatus that uses toners of four colors including black (K), cyan (C), magenta (M), and yellow (Y) as color materials, which is a general type of electrophotographic image forming apparatus, as an embodiment of the present disclosure. Note that the number of colors or an order of colors is not limited to the illustrated mode and the image forming apparatus is not limited to an apparatus of an intermediate transfer system and may be, for example, an apparatus of a direct transfer system.

FIG. 1 is a cross-sectional view of a schematic configuration of the image forming apparatus 100 according to an embodiment of the present disclosure. In FIG. 1, the image forming apparatus 100 is illustrated as a color printer that can form a full color image by employing a tandem system, and in which four imaging units 10K, 10C, 10M and 10Y (collectively referred to as image forming units 10 unless distinguished) are arranged at substantially a central portion of an apparatus body. The respective imaging units 10 (K, C, M and Y) are disposed side by side along an upper travel side of an intermediate transfer belt 11 which is an example of an intermediate transfer body. The intermediate transfer belt 11 wound around support rollers 12 and 13 is driven to travel counterclockwise in FIG. 1. A cleaning unit 14 is disposed to serve as a cleaner that performs cleaning of the intermediate transfer belt 11 and positioned between the support roller 12 and the yellow imaging unit 10Y.

Each of the imaging units 10 has the same configuration except that colors to be handled are different from each other, and is provided with a drum-shaped photoconductor 1 which is an example of an image bearer. A charger 2, a developing device (developing unit) 3, a cleaning device 4, and the like are arranged around the photoconductor 1, and primary transfer rollers 5 serving as primary transfer devices are disposed at an inner side of the intermediate transfer belt 11 so as to oppose each of the photoconductors 1.

A single component toner whose charge polarity is a negative polarity is stored in the developing unit 3. An electrostatic latent image on the photoconductor 1 is made visible as a toner image by a predetermined developing bias supplied from a high-voltage power supply.

An optical writing device 20 is disposed above the four imaging units 10. The optical writing device 20 includes, e.g., a polygon mirror and a set of mirrors, and irradiates a surface of the photoconductors 1 of the respective color imaging units 10 with an optically modulated laser beam. Note that, in some embodiments, a writing device may be provided for each of the imaging units 10.

A sheet feeder 30 is disposed at a lower portion of the image forming apparatus 100, and a sheet feeding tray 31 on which a sheet of paper P serving as a transfer target medium is loaded is disposed in the sheet feeder 30. A sheet feeding roller 32 is also disposed in the sheet feeding tray 31 to feed the sheet P, and a separation pad is disposed in the sheet feeding tray 31. The sheet fed with the sheet feeding roller 32 is conveyed to registration rollers (positioning rollers) 34 via conveyance rollers 33. A secondary transfer roller 35 serving as a secondary transfer device is disposed opposing the support roller 12 above the registration rollers 34 to form a secondary transfer portion.

A fixing device 40 is disposed above the secondary transfer portion. The fixing device 40 of this example includes a fixing roller and a pressure roller, and a sheet to which an unfixed toner image has been transferred is fixed by being subjected to heating and pressing at the secondary transfer portion. Sheet ejection rollers 41 are disposed above the fixing device 40. After fixing, the sheet is ejected onto a sheet ejection tray 42 that is formed on a top surface of the image forming apparatus 100.

An image forming operation in the image forming apparatus 100 thus configured is described below. When an imaging operation is started, the photoconductor 1 in each of the imaging units 10 is driven by a driving device to rotate clockwise in FIG. 1, and a surface of each photoconductor 1 is uniformly charged with a predetermined polarity by the charger 2. The charged surface of each photoconductor 1 is irradiated with the laser beam by the optical writing device 20, and an electrostatic latent image is formed on the surface of each photoconductor 1. Image information exposed to each photoconductor 1 is single color image information obtained by separating a desired full color image into color information of yellow, magenta, cyan, and black. When toner is supplied to the electrostatic latent image formed on each photoconductor 1 by each developing unit 3, the electrostatic latent image is made visible (visualized) as a toner image.

In addition, when the imaging operation is started, the support roller 12 is driven to rotate counterclockwise in FIG. 1, the intermediate transfer belt 11 is circulated to travel in a direction indicated by arrow R1 in FIG. 1. Further, a voltage (primary transfer bias) having an opposite polarity of the charge polarity of the toner is applied to each of the primary transfer rollers 5. The voltage is controlled to be a constant voltage or constant current. Accordingly, a transfer electric field is formed in a primary transfer nip (primary transfer portion) between each of the primary transfer rollers 5 and each of the photoconductors 1.

Toner images on the respective photoconductors 1 are sequentially superimposed one on another and transferred onto the intermediate transfer belt 11 by the transfer electric fields formed in the primary transfer nips when the toner images of the respective colors on the photoconductors 1 reach the primary transfer nips along with rotation of the photoconductors 1. Thus, a full color toner image is borne on the surface of the intermediate transfer belt 11. In addition, toner on each photoconductor 1 that has not been transferred to the intermediate transfer belt 11 is removed by the cleaning device 4.

The sheet feeding roller 32 starts to be driven to rotate at the lower side of the image forming apparatus 100, and the sheet P is fed to a conveyance path from the sheet feeding tray 31. The sheet P that has been fed to the conveyance path is sent to a secondary transfer nip between the secondary transfer roller 35 and the support roller 12 by the registration rollers (positioning rollers) 34 in synchronous with the toner images on the intermediate transfer belt 11. At this time, a transfer voltage (secondary transfer bias), which has an opposite polarity of the charge polarity of the toner on the intermediate transfer belt 11, is applied to the secondary transfer roller 35, and accordingly, a transfer electric field is formed in the secondary transfer nip.

The toner images on the intermediate transfer belt 11 are collectively transferred onto the sheet P by the transfer electric field formed in the secondary transfer nip when the toner images on the intermediate transfer belt 11 reach the secondary transfer nip along with the circulating traveling of the intermediate transfer belt 11. At this time, the residual toner on the intermediate transfer belt 11 that has not been transferred to the sheet P is removed by a cleaning blade 14*a* disposed to abut against the intermediate transfer belt 11 in the cleaning unit 14, and the removed toner is conveyed to and collected by a waste toner container. In some embodiments, for example, an electrostatic brush system or an electrostatic roller system may be employed instead of the above-described blade cleaning system.

The sheet P is conveyed to the fixing device 40, and the toner images on the sheet P are fixed to the sheet P by the fixing device 40. Further, the sheet P is ejected to the outside of the apparatus body by the sheet ejection rollers 41, and stacked on the sheet ejection tray 42.

The above description has been made by exemplifying the image forming operation when a full color image is formed on a sheet. In the image forming apparatus 100, for example, a two-color or three-color image can be formed using any two or three imaging units among the four imaging units 10Y, 10M, 10C and 10K.

Figure 2:
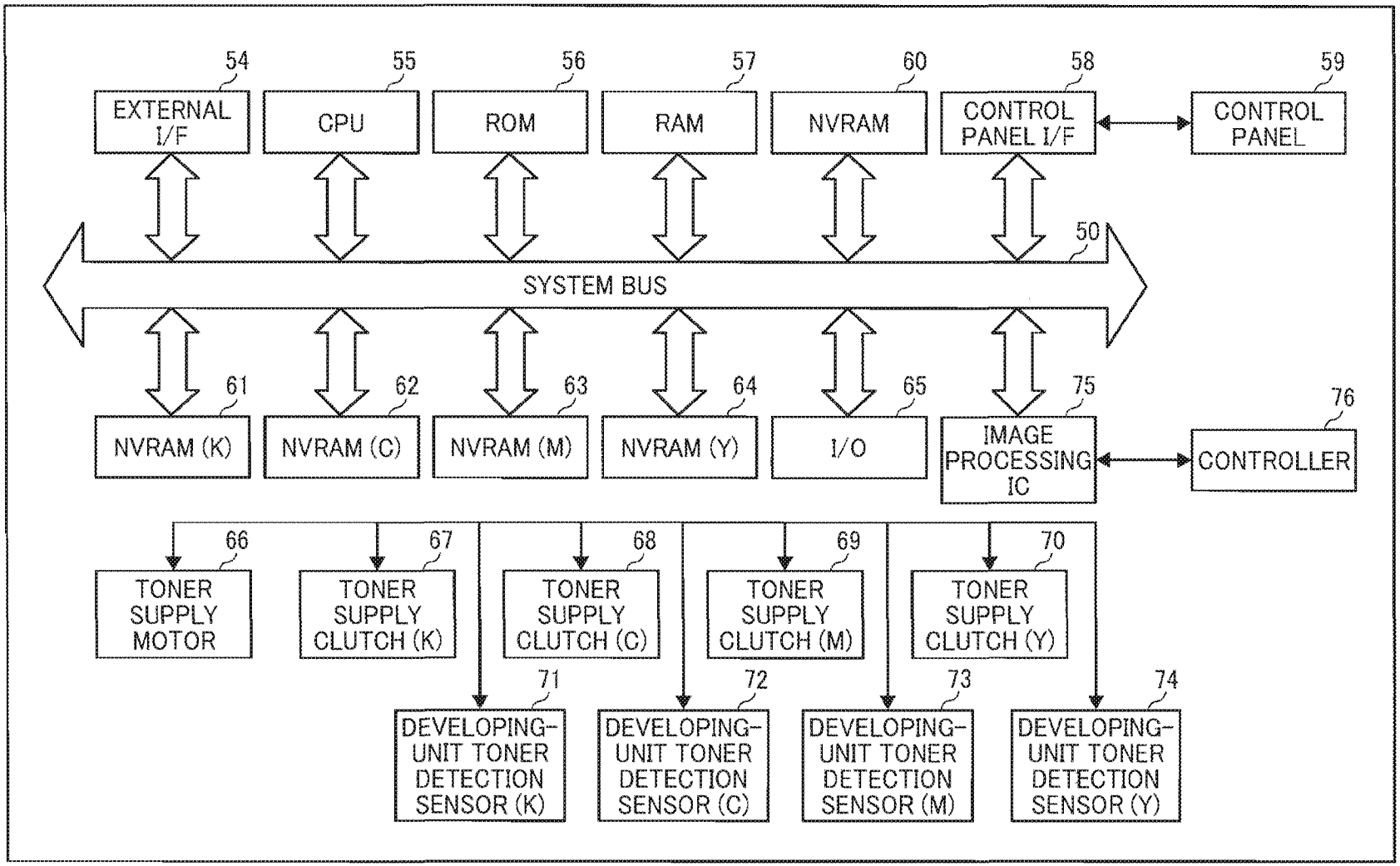
FIG. 2 is a block diagram of a control system of the image forming apparatus illustrated in FIG. 1 according to an embodiment of the present disclosure.

Next, a processing block of the image forming apparatus 100 is described. FIG. 2 is a block diagram of a control system of the image forming apparatus 100 according to the present embodiment.

A central processing unit (CPU) 55 is a CPU of the image forming apparatus 100, generally controls access with various device to be connected to a system bus 50 based on control programs which are stored in a read only memory (ROM) 56, and controls input and output of electric components, such as sensors, motors, clutches, and heaters which are connected via an input-output (I/O) 65.

The control programs and the like are stored in the ROM 56. The CPU 55 can not only execute the control programs stored in the ROM 56 but also perform communication processing with an external device, such as a host computer, via an external interface (I/F) 54.

A random access memory (RAM) 57 acts as, e.g., a main memory and a work area of the CPU 55, and is used as, e.g., a developing area of recorded data and a storage area of environment data.

Information relating to the image forming apparatus 100 used by the control programs is stored in a non-volatile random access memory (NVRAM) 60, NVRAMs 61, 62, 63 and 64 for K, C, M, and Y, respectively, are mounted to the respective toner containers, and information, such as remaining amounts of the toner containers, is stored in the NVRAMs 61, 62, 63, and 64.

A printer mode and other settings can be set using a control panel 59 connected via a control panel I/F 58. Each color toner is fed to the developing unit 3 from each of the toner containers by driving a toner supply motor 66 and turning ON each of toner supply clutches 67, 68, 69 and 70 for K, C, M, and Y, respectively. Developing-unit toner detection sensors 71, 72, 73 and 74 for K, C, M, and Y, respectively, are provided to detect the toner inside the respective developing units 3.

An image processing integrated circuit (IC) 75 receives image data from a controller 76 and transmits the image data to the optical writing device 20. Further, the image processing IC 75 has a function of calculating a toner consumption amount per one page from the image data received from the controller 76, and notifying the CPU 55 of the calculated toner consumption amount via the system bus 50.

Figure 3:
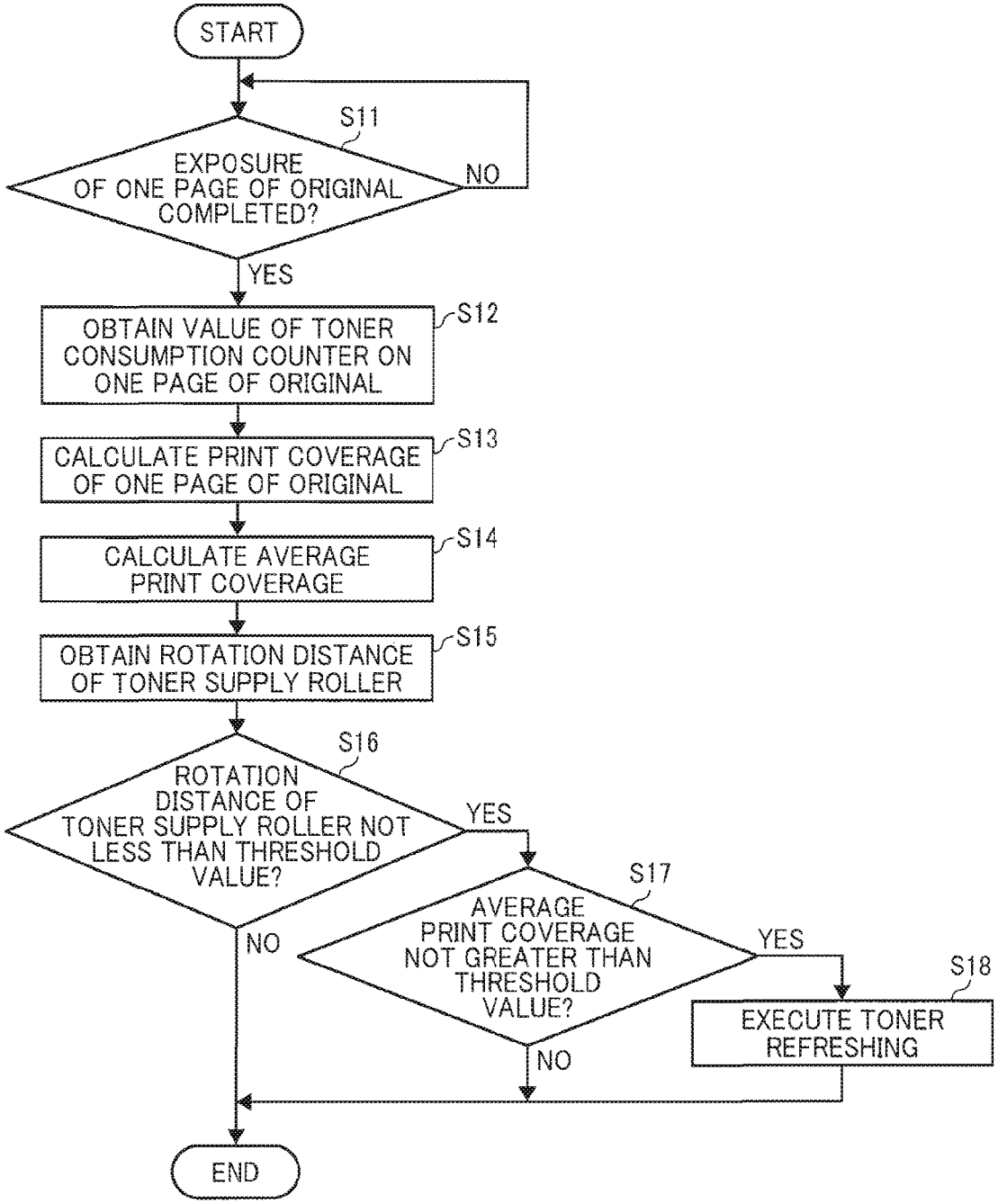
FIG. 3 is a flowchart of a procedure of a toner refreshing process of the image forming apparatus illustrated in FIG. 1 according to an embodiment of the present disclosure.

Next, a refreshing mode executing procedure (a procedure of toner refreshing process) is described with reference to a flowchart. FIG. 3 is a flowchart of the procedure of the toner refreshing process according to an embodiment of the present disclosure. When acquiring a print instruction of image data from the controller 76, the CPU 55 supplies the image data to the image processing IC 75 to start an exposure process using the optical writing device 20, and start the procedure of the toner refreshing process.

Subsequently, the CPU 55 determines whether the exposure process for one page of an original document has completed (step S11).

When it is determined that the exposure process for one page of the document has not completed, the CPU 55 repeats step S11 and waits for completion of the exposure process for one page of the original document. By contrast, when it is determined that the exposure process for one page of the document has completed, the CPU 55 acquires a value of a toner consumption counter on one page of the original document from the image processing IC 75 (step S12).

Subsequently, the CPU 55 calculates a print coverage T of one page of the original document for each color (C, M, Y or K) (step S13). Here, the print coverage T is obtained by dividing a value U of the toner consumption counter by a total number of pixels in a print range, that is, a value obtained by multiplying a number of pixels Px within a width of the toner supply roller by a number of pixels Q in a sub-scanning direction.

For example, it is assumed that the toner consumption counter value U of the black toner is 3,937,379 [dot]. When the width of the toner supply roller is 297 mm and the pixel density in a main scanning direction is 1,200 dpi, the number of pixels Px within the width of the toner supply roller becomes (297/25.4)×1,200=14,031 [dot] since 1 inch is 25.4 mm.

Meanwhile, when the pixel density in the sub-scanning direction is 2,400 dpi and the length of a document in the sub-scanning direction is 297 mm, the number of pixels Q in the sub-scanning direction becomes (297/25.4)×2,400=28,062 [dot]. Thus, the print coverage T becomes 3,937,379/(14,031×28,062)=0.01, and is calculated as about 1%.

The CPU 55 calculates an average print coverage (step S14). Here, the average print coverage is an average value of the print coverage that has been calculated after execution of the previous toner refreshing process, and the average print coverage and the number of pages that have been counted until the immediately previous page are stored for each color in the NVRAM 60.

Thus, the CPU 55 acquires from the NVRAM 60 the average print coverage and the number of pages calculated until the immediately previous page, calculates a new average print coverage based on the values and the print coverage T that is calculated at the current time, and updates the NVRAM 60 by storing the calculated value.

The CPU 55 acquires a rotation distance of the toner supply roller (step S15). The rotation distance of the toner supply roller, which has been obtained after execution of the previous toner refreshing process, is stored in the NVRAM 60. The CPU 55 acquires the rotation distance of the toner supply roller from the NVRAM 60.

The CPU 55 determines whether the rotation distance of the toner supply roller is not less than a predetermined threshold (step S16). The threshold is a value stored in advance in the NVRAM 60 and is set to, for example, 200 m. The threshold can be changed by an operation using the control panel 59.

When it is determined that the rotation distance of the toner supply roller is less than the predetermined threshold (NO at S16), the CPU 55 terminates the current toner refreshing process without executing the toner refreshing. By contrast, when it is determined that the rotation distance of the toner supply roller is not less than the predetermined threshold (YES at S16), the CPU 55 determines whether the average print coverage calculated in step S14 is not greater than a predetermined threshold (step S17). The threshold is stored in advance in the NVRAM 60 and is set to, for example, 1.5%. The threshold can be changed by an operation using the control panel 59.

When it is determined that the average print coverage calculated in step S14 is not greater than the predetermined threshold (NO at S17), the current toner refreshing process is terminated without executing the toner refreshing. By contrast, when it is determined that the average print coverage calculated in step S14 is not greater than the predetermined threshold (YES at S17), the toner refreshing process is executed to expose the entire surface of the photoconductor 1 during a non-image-formation period to forcefully consume toner adhering on the developing roller (step S18). The CPU 55 resets each value of the rotation distance of the toner supply roller and the average print coverage stored in the NVRAM 60 to "0", and terminates the toner refreshing process. The term "non-image-formation period" used herein means a period other than a normal image formation period.

When the above-described toner refreshing process is executed, old toner is discharged from the inside of the developing unit 3 by forming a toner pattern TP in an area between sheets on the intermediate transfer belt 11 at a predetermined timing such that degraded toner does not continuously remain in the developing unit 3 for a long period of time. Thus, a process to enhance the image quality can be performed.

Figures 4, 5:
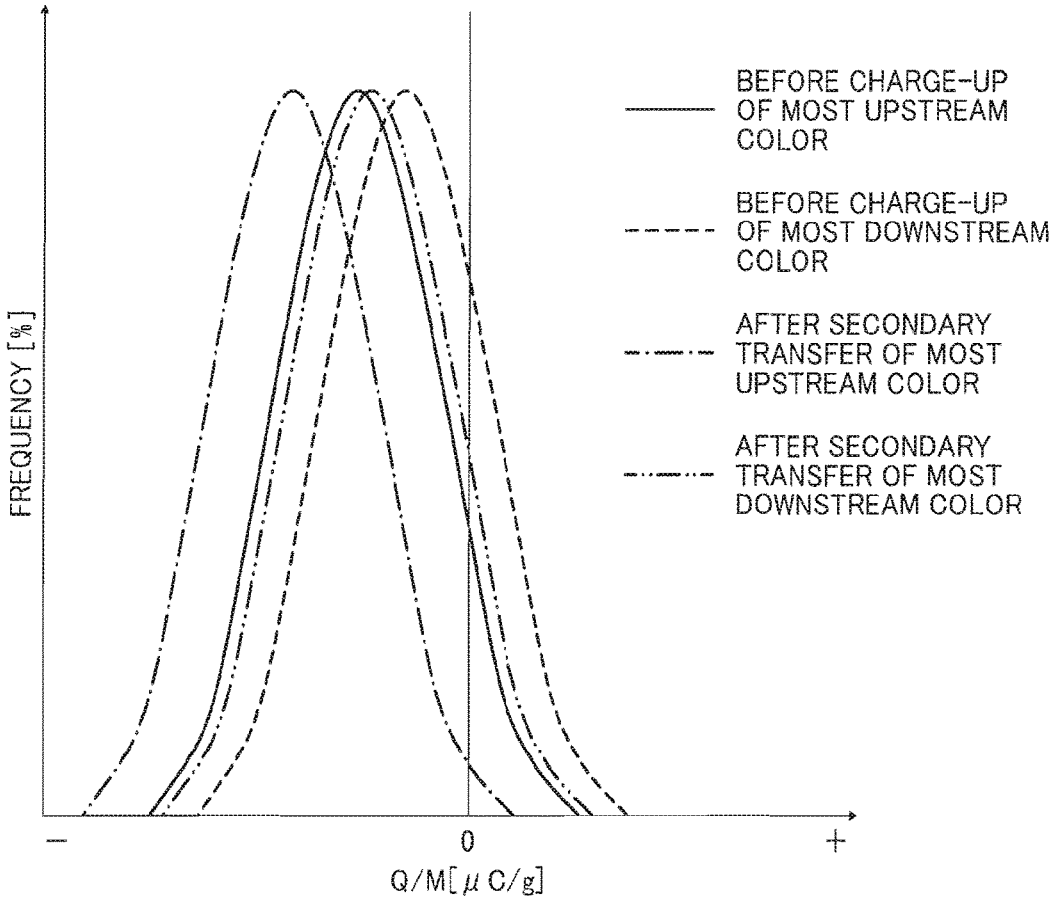
FIG. 4 is an illustration of a relationship between a position of an imaging unit and a charged amount of toner of the image forming apparatus illustrated in FIG. 1 according to an embodiment of the present disclosure.
FIG. 5 is an illustration of a relationship between a position of the imaging unit and the charged amount of toner of the image forming apparatus illustrated in FIG. 1 according to an embodiment of the present disclosure.

Meanwhile, toner discharged by the developing unit 3 disposed most downstream in a conveyance direction of the intermediate transfer belt 11 does not contact the photoconductors 1 (having the negative polarity) of the other colors. Accordingly, such toner has a higher electrostatic attraction force to the intermediate transfer belt 11 (having the negative polarity) and a poorer cleaning performance than the other-color toners as illustrated in FIG. 4. Thus, if the toner refreshing process is executed first for the most downstream developing unit 3 in the conveyance direction of the intermediate transfer belt 11, a dam layer to enhance the cleaning performance, which is described later, may not be formed, thus causing cleaning failure as illustrated in FIG. 5.

Figure 6:
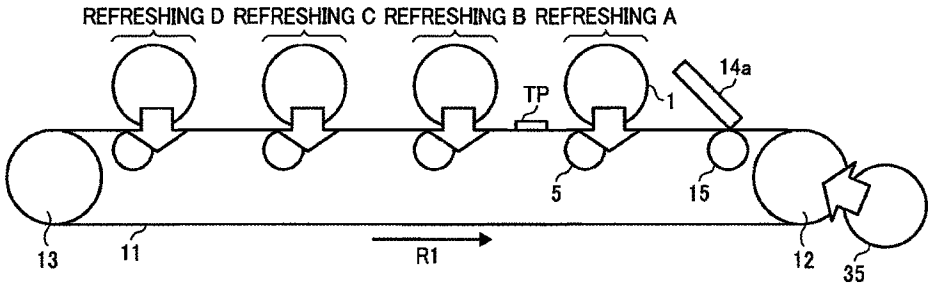
FIG. 6 is an illustration of a toner refreshing process of the image forming apparatus illustrated in FIG. 1 according to an embodiment of the present disclosure.

For example, when the toner refreshing process is started from refreshing toner (refreshing D) formed on the most downstream photoconductor 1 in the conveyance direction of the intermediate transfer belt 11 illustrated in FIG. 6, the refreshing toner does not contact the other-color photoconductors 1 (having the negative polarity), and thus, the electric charge is not charged-up to the polarity (negative polarity) that weakens the electrostatic attraction force to the intermediate transfer belt 11 (having the negative polarity). Accordingly, as illustrated in FIG. 7B, the toner (of the positive polarity) having reached the cleaning unit 14 is less likely to be scraped off by the cleaning blade 14*a*, which may hamper formation of a dam layer DM and leads to the degradation of the cleaning performance.

Next, the toner refreshing process according to the present embodiment is described. The developing unit 3 forms a refreshing toner image on the photoconductor 1 during the non-image-formation period. The refreshing toner image formed on the photoconductor 1 is transferred onto the intermediate transfer belt 11 by the transfer electric field at the primary transfer nip. The refreshing process is executed as the refreshing toner image transferred to the intermediate transfer belt 11 is subjected to cleaning performed by the cleaning unit 14. The refreshing toner images on the respective photoconductors 1 are transferred onto the intermediate transfer belt 11 separately from each other and are not superimposed one on another.

In the present embodiment, the toner refreshing process is started from refreshing toners (refreshing A, refreshing B, and refreshing C) formed on the photoconductors 1 other than the most downstream one in the conveyance direction of the intermediate transfer belt 11 illustrated in FIG. 6. The refreshing toner image, which has been transferred from any one of the photoconductors 1 other than the most downstream photoconductor 1 to the intermediate transfer belt 11, contacts and passes at least one photoconductor 1 other than the one photoconductor 1. At this time, a bias having the negative polarity, which is the same polarity as the polarity of the refreshing toner, is applied to the photoconductor 1 in contact with the refreshing toner image. Further, when the refreshing, toner passes the secondary transfer roller 35, a bias having the negative polarity, which is the same polarity as the polarity of the refreshing toner, may be applied to the secondary transfer roller 35.

Then, the electric charge is charged up to the polarity (the negative polarity), which weakens the electrostatic attraction force to the intermediate transfer belt 11 (having the negative polarity) whenever the refreshing toner (having the negative polarity), which has been primarily transferred to the intermediate transfer belt 11, contacts the other-color photoconductors 1 (having the negative polarity). Further, the electric charge is charged up to the polarity (the negative polarity), which weakens the electrostatic attraction force to the intermediate transfer belt 11 (having the negative polarity) when the refreshing toner passes the secondary transfer roller 35 (having the negative polarity).

In the present embodiment, the bias to be applied to the refreshing toner, the photoconductor 1, and the secondary transfer roller 35 is set to the negative polarity. However, the bias is not limited to the negative polarity. For example, when the refreshing toner image transferred from one photoconductor 1 to the intermediate transfer belt 11 contacts and passes the other photoconductors 1, a bias having the same polarity as a polarity of the refreshing toner may be applied to the photoconductor 1 being in contact, and a bias having the same polarity as the polarity of the refreshing toner may be applied to the secondary transfer roller 35 when the refreshing toner passes the secondary transfer roller 35.

Figure 7A:
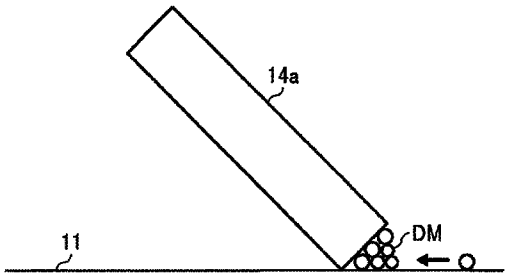
FIGS. 7A and 7B are illustrations of the toner refreshing process of the image forming apparatus illustrated in FIG. 1 according to an embodiment of the present disclosure.
Figure 7B:
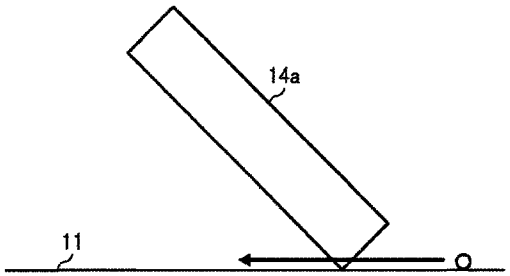

The toner (having the negative polarity) having reached the cleaning unit 14 is scraped off by the cleaning blade 14*a* as illustrated in FIG. 7A, and deposited at the leading end of the cleaning blade 14*a*, thereby forming the dam layer DM.

Thereafter, the refreshing toner (refreshing D) formed on the most downstream photoconductor 1 in the conveyance direction of the intermediate transfer belt 11 reaches the cleaning unit 14. In other words, the refreshing toner image formed on any of the photoconductors 1 except for the most downstream photoconductor 1 in the conveyance direction of the intermediate transfer belt 11 reaches the cleaning unit 14 first. Such a configuration can prevent a cleaning failure of the refreshing toner formed on the most downstream photoconductor 1 in the conveyance direction of the intermediate transfer belt 11.

The refreshing toner (refreshing D) formed on the most downstream photoconductor 1 in the conveyance direction of the intermediate transfer belt 11 preferably reaches the cleaning unit 14 last. The refreshing toner formed on the most downstream photoconductor 1 reaches the cleaning unit 14 without passing the primary transfer portions of the other colors, thus preventing the cleaning failure.

The refreshing toner formed on the most downstream photoconductor 1 in the conveyance direction of the intermediate transfer belt 11 reaches the cleaning unit 14 after all the refreshing toners formed on the photoconductors 1 other than the most downstream photoconductor 1 in the conveyance direction of the intermediate transfer belt 11 reach the cleaning unit 14.

Accordingly, all the refreshing toners (refreshing A, refreshing B, and refreshing C), formed on the photoconductors 1 other than the most downstream photoconductor 1 in the conveyance direction of the intermediate transfer belt 11 reach the cleaning unit 14 and form the dam layer DM on the cleaning blade 14*a*, and the refreshing toner (refreshing D) formed on the most downstream photoconductor 1 in the conveyance direction of the intermediate transfer belt 11 is easily cleaned by the cleaning blade 14*a* with the dam layer DM, thus preventing the cleaning failure. As shown in FIG. 6, there is a transfer roller 15 disposed on the other side of the transfer belt 11 opposing the cleaning blade 14*a*.

In addition, the refreshing toners preferably reach the cleaning unit 14 sequentially from the refreshing toner (refreshing A) formed on the most upstream photoconductor 1 in the conveyance direction of the intermediate transfer belt 11, that is, in the order of refreshing A, refreshing B, refreshing C, and refreshing D. As the photoconductor 1 on which the refreshing toner is formed is located more upstream in the conveyance direction of the intermediate transfer belt 11, the number of times that the refreshing toner passes the primary transfer portion before the refreshing toner reaches the cleaning unit 14 increases. Thus, the refreshing toner is more likely to be charged up. In other words, as the photoconductor 1 on which the refreshing toner is formed is located more upstream in the conveyance direction of the intermediate transfer belt 11, the refreshing toner is more likely to form the dam layer DM in the cleaning unit 14. Hence, in the present embodiment, the refreshing toner formed more upstream in the conveyance direction of the intermediate transfer belt 11 reach the cleaning unit 14 earlier, thus more reliably preventing cleaning failure.

The present embodiment has been described using the example in which the refreshing toner (refreshing D) formed on the most downstream photoconductor 1 in the conveyance direction of the intermediate transfer belt 11 reaches the cleaning unit 14 last. However, the order in which the refreshing toners reach the cleaning unit 14 is not limited to the above-described example. For example, in some embodiments, the refreshing toner (refreshing D) formed on the most downstream photoconductor 1 in the conveyance direction of the intermediate transfer belt 11 may reach the cleaning unit 14 second or third. Such a configuration can also more reliably prevent the cleaning failure than the configuration in which the refreshing toner formed on the most downstream photoconductor 1 in the conveyance direction of the intermediate transfer belt 11 reaches the cleaning unit 14 first.

In addition, the present embodiment has been described using the example in which the refreshing toner reaches the cleaning unit 14 sequentially from the refreshing toner (refreshing A) formed on the most upstream photoconductor 1 in the conveyance direction of the intermediate transfer belt 11. However, the order in which the refreshing toners reach the cleaning unit 14 is not limited to the above-described example. For example, in some embodiments, the refreshing toner may reach the cleaning unit 14 in the order of refreshing C, refreshing B, refreshing A, and refreshing D. Such a configuration can also more reliably prevent the cleaning failure than the configuration in which the refreshing toner formed on the most downstream photoconductor 1 in the conveyance direction of the intermediate transfer belt 11 reaches the cleaning unit 14 first.

Next, execution timing of the toner refreshing process is described. When an image forming operation with a low print coverage (not greater than 2%) is continued, the toner refreshing process is started from the refreshing toner formed on the photoconductor 1 more upstream in the conveyance direction of the intermediate transfer belt 11, and is executed last for the refreshing toner formed on the most downstream photoconductor 1 in the conveyance direction of the intermediate transfer belt 11 as illustrated in FIG. 8. Such a configuration can prevent the cleaning failure, which is generated due to the decrease of the charging capability or the charge-retaining capability and the increase of the electrostatic attraction force applied to the intermediate transfer belt 11 (having the negative polarity), with respect to the refreshing toner formed on the most downstream photoconductor 1 in the conveyance direction of the intermediate transfer belt 11. In the present embodiment, the proportion of an area to be printed with respect to an area in which an image having the low print coverage can be formed is set to be not greater than 2%. However, the proportion is not limited to 2% or lower and may be any other suitable value.

In addition, it is not that the cleaning failure, which is generated when the toner refreshing process of the refreshing toner formed on the most downstream photoconductor 1 in the conveyance direction of the intermediate transfer belt 11 is executed first, occurs only when the image forming operation with the low print coverage is continued.

For example, the occurrence of the cleaning failure is affected by the degree of durability of the developing unit 3 as illustrated in FIG. 9, and the toner degradation proceeds as the degree of durability increases, and accordingly, the charging capability or the charge-retaining capability decreases, thereby generating the cleaning failure. Even when the degree of durability is high (the rotation distance of the toner supply roller is equal to or longer than 5 km), the toner refreshing process is started from the refreshing toner formed on the photoconductor 1 more upstream in the conveyance direction of the intermediate transfer belt 11, and is executed last for the refreshing toner formed on the most downstream photoconductor 1 in the conveyance direction of the intermediate transfer belt 11, as illustrated in FIG. 8. Such a configuration can prevent the cleaning failure in the refreshing toner formed on the most downstream photoconductor 1 in the conveyance direction of the intermediate transfer belt 11 that is generated as the charging capability or the charge-retaining capability decreases and the electrostatic attraction force applied to the intermediate transfer belt 11 (having the negative polarity) increases. In the present embodiment, the high durability is set to the case in which the rotation distance of the toner supply roller is equal to or longer than 5 km. However, the setting of the high durability is not limited to the example and may be any other suitable value.

In addition, the occurrence of the cleaning failure is also affected by use environment of the image forming apparatus 100. For example, the cleaning failure is generated under a high-temperature and high-humidity (HH) environment (temperature 27° C. and humidity 80%) since toner is affected by humidity so that the charge-retaining capability decreases. In the case of the HH environment, as illustrated in FIG. 9, the toner refreshing process is also started from the refreshing toner formed on the photoconductor 1 more upstream in the conveyance direction of the intermediate transfer belt 11, and is executed last for the refreshing toner formed on the most downstream photoconductor 1 in the conveyance direction of the intermediate transfer belt 11. Such a configuration can prevent the cleaning failure in the refreshing toner formed on the most downstream photoconductor 1 in the conveyance direction of the intermediate transfer belt 11 that is generated as the charging capability or the charge-retaining capability decreases and the electrostatic attraction force applied to the intermediate transfer belt 11 (having the negative polarity) increases. In the present embodiment, the HH environment is set to the environment with temperature of 27° C. and humidity of 80%. However, the HH environment is not limited to the example.

The cleaning failure can be prevented by starting the toner refreshing process from the refreshing toner formed on the photoconductor 1 more upstream in the conveyance direction of the intermediate transfer belt 11, in consideration of the average print coverage, the rotation distance of the toner supply roller, and the environment. The degree of degradation of toner is affected by a developing condition, such as image coverage or environment. Thus, the order in which the refreshing toners formed on the photoconductors 1 reach the cleaning unit 14 may be controlled based on the developing condition, such as image coverage the environment in the refreshing mode such that the toner refreshing process is started from the refreshing toner formed on the photoconductor 1 more upstream in the conveyance direction of the intermediate transfer belt 11 or the toner refreshing processes for the refreshing toners formed on the respective photoconductors 1 are executed at the same time. Such a configuration can more effectively save the degree of durability of the developing unit 3 and the toner consumption than the toner refreshing process of the above-described embodiment.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an intermediate transfer body;

a plurality of image bearers disposed side by side along the intermediate transfer body;

a plurality of developing devices to form toner images on the plurality of image bearers;

a plurality of primary transfer devices disposed opposing the plurality of image bearers, to sequentially transfer the toner images from the plurality of image bearers to the intermediate transfer body with a primary transfer bias;

a secondary transfer device to collectively transfer the toner images from the intermediate transfer body to a transfer target with a secondary transfer bias; and a cleaner to clean a surface of the intermediate transfer body after transfer, wherein, in a refreshing mode, the plurality of developing devices form toner images on the plurality of image bearers during a non-image-formation period and the cleaner cleans the surface of the intermediate transfer body, and wherein, in the refreshing mode, a toner image formed on one image bearer of the plurality of image bearers, which differs from a most downstream image bearer of the plurality of image bearers in a direction of conveyance of the intermediate transfer body, reaches the cleaner first of the toner images formed on the plurality of image bearers.

2. The image forming apparatus according to claim 1, wherein, in the refreshing mode, a toner image formed on the most downstream image bearer in the direction of conveyance of the intermediate transfer body reaches the cleaner last of the toner images formed on the plurality of image bearers.

3. The image forming apparatus according to claim 2, wherein, in the refreshing mode, the toner images reach the cleaner sequentially from a toner image formed on a most upstream image bearer of the plurality of image bearers in the direction of conveyance of the intermediate transfer body to the toner image formed on the most downstream image bearer.

4. The image forming apparatus according to claim 1, wherein, in the refreshing mode, when a Loner image transferred from any one image bearer of the plurality of image bearers to the intermediate transfer body contacts and passes another image bearer differing from the any one image bearer, a bias having a same polarity as a polarity of toner is applied to the another image bearer.

5. The image forming apparatus according to claim 1, wherein, in the refreshing mode, when a toner image passes the secondary transfer device, a bias having a same polarity as a polarity of toner is applied to the secondary transfer device.

6. The image forming apparatus according to claim 1, wherein the toner image is input to the cleaner.

7. The image forming apparatus according to claim 1, wherein an order in which the toner images formed on the plurality of image bearers reach the cleaner is controlled based on a developing condition or an environment.

* * * * *